US009499313B2

(12) United States Patent
Zhong et al.

(10) Patent No.: US 9,499,313 B2
(45) Date of Patent: Nov. 22, 2016

(54) CAP WITH A SAFETY DEVICE

(71) Applicant: Foshan Nanhai Lida Packaging Co., Ltd., Guangdong (CN)

(72) Inventors: Jianchang Zhong, Guangdong (CN); Sunian Chen, Guangdong (CN)

( * ) Notice: Subject to any disclaimer, the term of this patent is extended or adjusted under 35 U.S.C. 154(b) by 0 days.

(21) Appl. No.: 14/603,289

(22) Filed: Jan. 22, 2015

(65) Prior Publication Data

US 2016/0130043 A1 May 12, 2016

(30) Foreign Application Priority Data

Nov. 12, 2014 (CN) ..... 2014 1 0635057

(51) Int. Cl.
*B65D 41/34* (2006.01)

(52) U.S. Cl.
CPC ..... *B65D 41/3409* (2013.01); *B65D 2101/003* (2013.01)

(58) Field of Classification Search
CPC .. B65D 41/0471; B65D 41/04; B65D 41/06; B65D 41/3409; B65D 41/3404; B65D 41/34; B65D 51/24; B65D 50/045; B65D 50/061; B65D 39/10; B65D 39/08; B65D 39/16; B65D 1/0246; B65D 1/023
USPC ..... 220/298, 300, 301, 293, 288, 212.5, 220/212, 319, 315; 215/330, 329, 316, 225, 215/224, 201, 44, 43, 228
See application file for complete search history.

(56) References Cited

U.S. PATENT DOCUMENTS

| | | | | |
|---|---|---|---|---|
| 2,423,582 A * | 7/1947 | Coleman | B65D 41/3404 | 215/252 |
| 3,716,161 A * | 2/1973 | Julian | B65D 41/06 | 215/330 |
| 6,378,713 B2 * | 4/2002 | Montgomery | B65D 41/065 | 215/222 |
| 2006/0068310 A1 * | 3/2006 | Nozomi | G03G 5/047 | 430/96 |
| 2007/0144999 A1 * | 6/2007 | King | B65D 41/0421 | 215/330 |

* cited by examiner

*Primary Examiner* — Robert J Hicks
(74) *Attorney, Agent, or Firm* — Prakash Nama; Global IP Services, PLLC

(57) ABSTRACT

A cap with a safety device; the cap is rotatably and removably mounted on a tubular opening of a packaging container; the cap comprises a cap body and a grip ring connected via first fixation wings; the cap also comprises a safety outer ring and safety pawls; the safety outer ring is fixed at outer periphery of a bottom end of the cap body; the safety pawls are multiple in terms of quantity, and are circularly distributed at inner side of the safety outer ring; gaps corresponding to the safety pawls are provided on the safety outer ring; each safety pawl comprises a fixation end and an engagement end; when the cap is rotated to open, the engagement end engages and antagonizes with a corresponding ratchet tooth to perform irreversible rotation around its corresponding fixation end.

13 Claims, 12 Drawing Sheets

CAP WITH A SAFETY DEVICE

BACKGROUND OF THE INVENTION

The present invention relates to a container cap mounted at an opening of a packaging container for sealing the packaging container. In particular, the present invention relates to a cap with a safety device against cheating behavior.

A cap is generally used for sealing a mouth portion of a packaging container. The mouth portion of a packaging container commonly available in the market has a tubular shape. The cap is generally mounted rotatably and removably at the tubular mouth portion. For years, notorious cheating behavior in association with a capped packaging container such as replacement of its contents after opening the cap without leaving any traces of the cap being opened has become a social problem. Consequently, a container cap having an anti-theft ring is invented, in which, the container cap comprises a cap body and an anti-theft ring connected to the edge of the cap; the cap body has a cylindrical shape closing at one end and having an opening at another end; the cap body is mounted at a tubular mouth portion of a packaging container; the cap body and the tubular mouth portion are connected and tightened together via screw threads; the anti-theft ring comprises multiple sections of ring parts; tearable seams are used for connecting adjacent ring parts; the tearable seams will be torn upon slight rotation of the cap in order to simply and directly reflect whether the cap has ever been opened or not; inner wall of the anti-theft ring is provided with at least two claws, and there are connecting pieces provided circumferentially between the cap body and the anti-theft ring to ensure that the anti-theft ring will be displaced and deformed but will not be completely separated from the cap body after the cap is opened.

In prior arts such as CN102627165B, a cap and a tubular mouth piece are disclosed; the tubular mouth piece is positioned on the packaging container; the cap seals a mouth portion of the tubular mouth piece; outer periphery of the mouth portion of the tubular mouth piece is provided with multiple ratchet teeth; multiple pawls engaging correspondingly to the multiple ratchet teeth are provided at an inner side of the anti-theft ring of the cap; when the cap starts to be rotated, the ratchet teeth and the pawls engage; when the cap continues to be rotated, the anti-theft ring will be torn irreversibly under the antagonizing effect between the ratchet teeth and the pawls; accordingly, it can be determined whether the cap has ever been opened. However, this kind of cap against cheating behavior still has some disadvantages. Packaging containers especially beverage containers loved by kids will become the kids' play things. However, the cap with a safety device now available in the market usually has sharp protrusions due to tearing and damaging of the anti-theft ring. The sharp protrusions are particularly dangerous to the kids when the kids play with the packaging containers. It is particularly dangerous also because the kids are the major target consumers of those products.

Besides, the caps of some beverage containers now available in the market are relatively small and these caps can be easily swallowed by small kids causing suffocation if the caps are trapped at the throat. If the caps are not taken out immediately, the kids' lives may be put at risk. To solve this problem and to prevent accidental swallowing of the caps, larger caps are designed according to the sizes of the kids' opened mouths so that the kids cannot swallow the caps.

Although this method can prevent most of the kids from accidentally swallowing the caps, exceptional situations cannot be ruled out, for example, if the kids have larger mouths or in situations where the kids are older.

BRIEF SUMMARY OF THE INVENTION

In view of the aforesaid disadvantages now present in the prior arts, the present invention is a cap with a safety device providing enhanced safety protection. Compared with the prior arts, the present invention is a new technical solution for safety against cheating behavior.

The technical solution provided by the present invention is set out as follows: A cap with a safety device; the cap is rotatably mounted at a tubular opening of a packaging container; outer periphery of the tubular opening is provided with ratchet teeth engaging with the cap; wherein the cap comprises a cap body, a safety outer ring and safety pawls; the safety outer ring is fixed at a bottom end of the cap body; the safety pawls are multiple in terms of their quantity; the safety pawls are circularly distributed at inner side of the safety outer ring; each of the safety pawls comprises a fixation end and an engagement end; when the cap is rotated to open, each engagement end engages with a corresponding ratchet tooth of the ratchet teeth and then perform irreversible rotation around its corresponding fixation end.

The cap with a safety device according to the present invention has "double circles" for safety against cheating behavior; a first circle is the safety outer ring for the purpose of protection to protect and fix the safety pawls not to be damaged intentionally or accidentally before they are torn; after the safety pawls have been torn, the safety pawls are retained within the inner side of the safety outer ring to prevent outward formation of sharp protrusions; under antagonism with the ratchet teeth, the engagement ends of the safety pawls perform irreversible rotation around their corresponding fixation ends and thus tear the safety pawls; the engagement ends are eventually positioned in positions after the irreversible rotation stops; the safety pawls will not fall off after being torn, thereby being safer and more environmental-friendly.

Preferably, gaps corresponding to the safety pawls are provided on the safety outer ring; the gaps are used for observing the safety pawls; two sides of each gap on the safety outer ring are raised platforms.

The gaps on the safety outer ring facilitate sideward observation by users to check whether the safety pawls have ever been torn so as to determine whether the cap has ever been opened. The raised platforms are provided to protect the safety pawls interior to the safety outer ring from being damaged intentionally or accidentally from outside.

Preferably, the cap also comprises supporting pieces connecting engagement ends of the safety pawls with an inner surface of the safety outer ring; the supporting pieces will be torn when the engagement ends rotate around their corresponding fixation ends.

The supporting pieces are provided between the safety pawls and the inner surface of the safety outer ring to support and increase the stability of the safety pawls before they are torn, to act as additional indicators of determining whether the safety pawls have been torn, and to hide sharp protrusions by hiding the torn supporting pieces at the inner side of the safety outer ring.

Preferably, the safety outer ring and the safety pawls are radially exterior to the bottom end of the cap body.

Preferably, engagement ends of the safety pawls rotate around their corresponding fixation ends within a circular plane on which the safety outer ring is situated when the cap is rotated to open.

Preferably, the engagement end is a front end of its corresponding safety pawl along a direction of opening the cap by rotation; the fixation end is a rear end of its corresponding safety pawl along the direction of opening the cap by rotation; each engagement end comprises an engagement slot; an opening of the engagement slot faces along the direction of opening the cap by rotation; the engagement slot fits and engages with a corresponding ratchet tooth.

Preferably, the engagement slot is formed as a notch created between two pawl legs extending away from each other according to a certain angle.

Preferably, the opening being formed as the engagement slot has a triangular shape.

Preferably, the cap also comprises a grip ring provided on an outer periphery of the cap body; the cap body and the grip ring are integrally connected with each other via first fixation wings; the first fixation wings are multiple in terms of their quantity; the first fixation wings are radially distributed between an inner wall of the grip ring and the cap body connecting the inner wall of the grip ring and the cap body; the safety outer ring is fixed by connecting the safety outer ring with lower edges of the first fixation wings as a one whole piece.

Preferably, the fixation end of each of the safety pawls is fixed at an end portion of a corresponding second fixation wing of multiple second fixation wings extending from an inner surface of the grip ring to an inner side of the safety outer ring.

The second fixation wings extend from the inner surface of the grip ring to the inner side of the safety outer ring, but do not connect with the cap body. This kind of configuration has the following advantages: 1. Demolding procedure during manufacture of the cap is less difficult and less costly; 2. Users can observe whether the safety pawls are intact from another viewing angle such as a viewing angle from top to bottom.

Preferably, the safety outer ring is also fixed with lower edges of the second fixation wings as a one whole piece.

Preferably, a vertical through passage is formed between the grip ring and the cap body.

Preferably, the grip ring is a circular structure continuously surrounding the outer periphery of the cap body; alternatively, the grip ring is formed by multiple sections continuously or discontinuously surrounding the outer periphery of the cap body.

Preferably, recesses are provided between top portions of two adjacent sections; a top surface of the cap body is lower than an edge of a top part of the grip ring.

These configurations have the following advantages: recesses create sideward ventilation on the cap, so that air can enter into a space enclosed by the grip ring through a recess between the top portions of any two adjacent sections, flow through the space between the top surface of the cap body and the top portion of the grip ring, and then flow out from another recess, as such, the cap is enabled with both vertical and sideward ventilation to reduce the risk of suffocation in case the cap is accidentally swallowed by the kids.

Preferably, troughs are provided between outer surfaces of two adjacent sections.

This configuration has the following advantages: 1. troughs provided on the outer surface of the grip ring can achieve anti-slippery effect; 2. it is easier to position and grab the cap during production and processing.

Preferably, there are four to six sections; the first fixation wings and the sections have the same quantity; the first fixation wings are positioned and connected between connecting portions of adjacent sections and the cap body; the second fixation wings and the sections also have the same quantity; the second fixation wings and the first fixation wings are arranged alternately; the safety pawls and the sections also have the same quantity.

DETAILED DESCRIPTION OF THE INVENTION

The present invention is described further in detail below with reference to the accompanying drawings.

Embodiment 1

As shown in FIGS. 1-6, the present embodiment of the present invention is a cap with a safety device; the cap is rotatably and removeably mounted at a tubular opening of a packaging container; an outer periphery of the tubular opening is provided with ratchet teeth engaging with the cap. In the present embodiment, the cap comprises a cap body 1 and a grip ring 2; the grip ring 2 is provided on an outer periphery of the cap body 1; the cap body 1 and the grip ring 2 are integrally connected with each other via first fixation wings 21.

Figure 3:
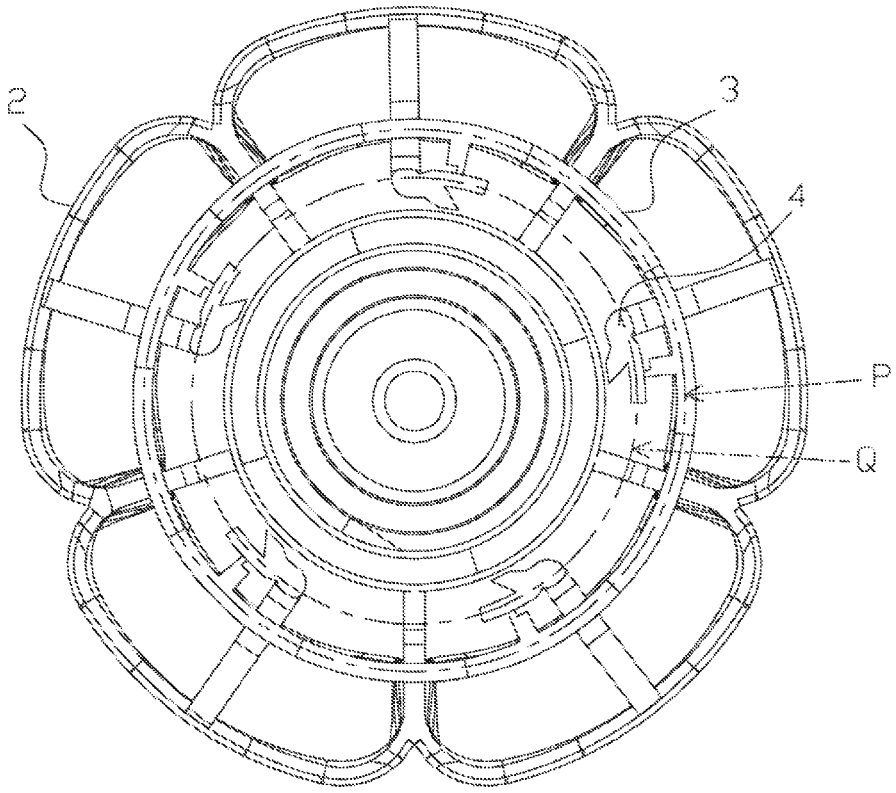
FIG. 3 is a schematic view showing the double circles on the bottom surface of the cap according to an embodiment of the present invention.

The cap also comprises a safety outer ring 3 and safety pawls 4. The safety outer ring 3 is fixed at an outer periphery of a bottom end of the cap body 1. The bottom end of the cap body 1 is radially interior to the safety outer ring 3. A quantity of the safety pawls 4 is five. The safety pawls 4 are circularly distributed around an inner side of the safety outer ring 3. As shown in FIG. 3, a circle Q on which the safety pawls 4 are distributed is interior to a circle P on which the safety outer ring 3 is positioned.

Figure 6:
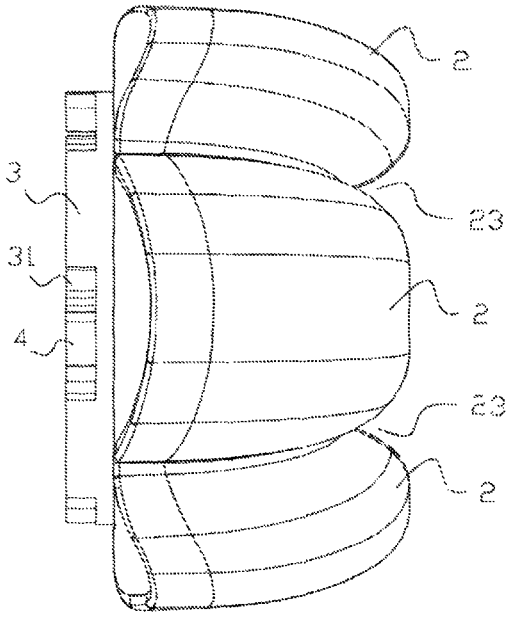
FIG. 6 is a side view of the cap according to an embodiment of the present invention.
Figure 7:
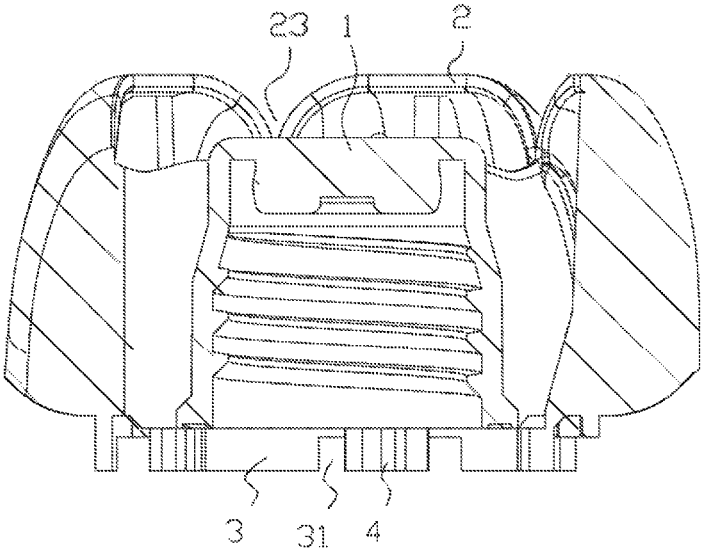
FIG. 7 is a sectional view of the cap according to an embodiment of the present invention.

Gaps 31 corresponding to the safety pawls 4 are provided on the safety outer ring 3. The gaps 31 are used for sideward observation of the safety pawls 4. As shown in FIGS. 6-7, the safety pawls 4 can be observed through the gaps 31.

Each of the safety pawls 4 comprises a fixation end and an engagement end; the engagement end rotates around the fixation end through engagement and antagonism with a corresponding ratchet tooth when the cap is opened by rotation; the engagement end is a front end of its corresponding safety pawl along a direction of opening the cap by rotation; the fixation end is a rear end of its corresponding safety pawl along the direction of opening the cap by rotation.

Figure 1:
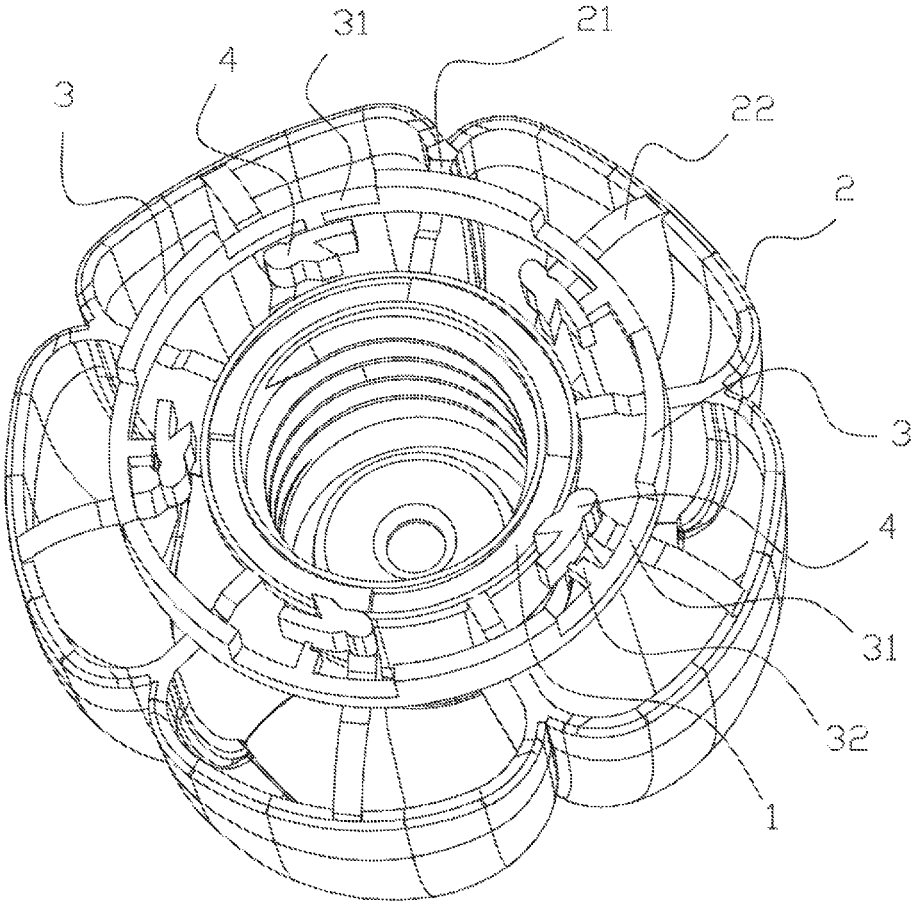
FIG. 1 is a perspective view of an embodiment of the cap of the present invention viewing from the bottom surface of the cap.
Figure 2:
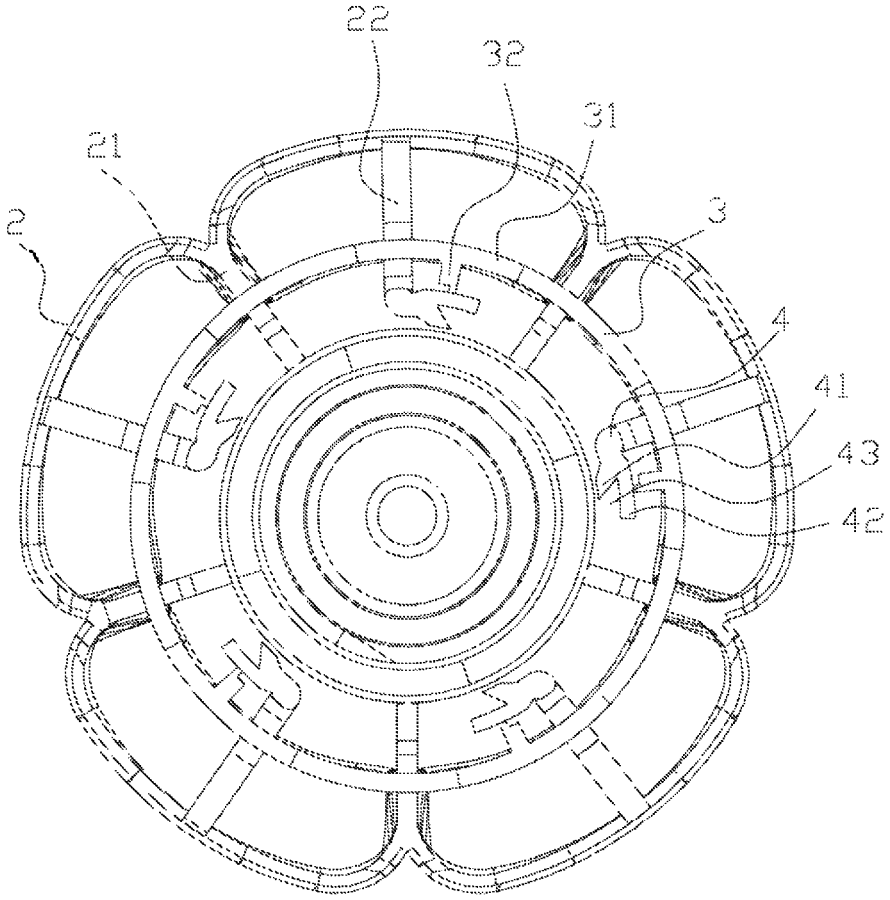
FIG. 2 is a bottom plan view of the cap according to an embodiment of the present invention.

As shown in FIG. 2, each engagement end comprises an engagement slot 43; the engagement slot 43 fits and engages with a corresponding ratchet tooth; the engagement slot 43 is formed as a notch created between two pawl legs 41, 42 extending away from each other according to a certain angle; the opening being formed as the engagement slot 43 has a triangular shape.

The fixation end of each of the safety pawls 4 is fixed at an end portion of a corresponding second fixation wing of multiple second fixation wings 22 extending from an inner surface of the grip ring 2 to an inner side of the safety outer ring 3, and the safety pawls 4 are radially exterior to the bottom end of the cap body 1. These configurations have the following advantages: 1. Demolding procedure during manufacture of the cap is less difficult and less costly; 2. Users can observe whether the safety pawls 4 are intact from another viewing angle such as a viewing angle from the top to the bottom. Hence, a vertical through passage is formed between the grip ring 2 and the cap body 1.

In this embodiment, the cap also comprises supporting pieces 32 connecting engagement ends of the safety pawls 4 with an inner surface of the safety outer ring 3. The supporting pieces 32 will be torn when the engagement ends rotate around their corresponding fixation ends.

Figure 8:
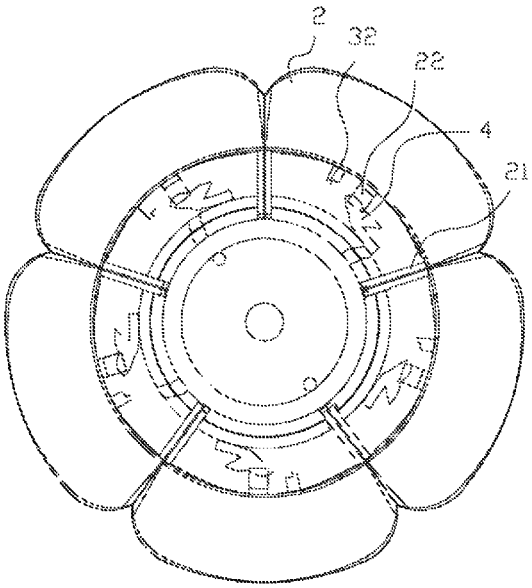
FIG. 8 is a top plan view showing the torn safety pawls of the cap according to an embodiment of the present invention.
Figure 9:
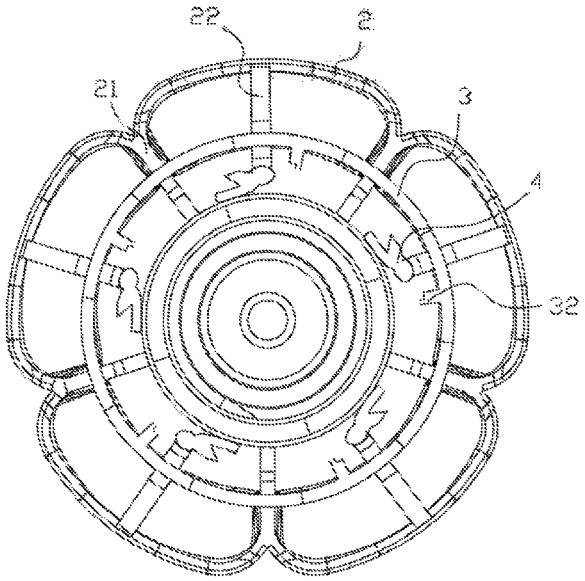
FIG. 9 is a bottom plan view showing the torn safety pawls of the cap according to an embodiment of the present invention.

The supporting pieces 32 are provided between the safety pawls 4 and the inner surface of the safety outer ring 3 according to the present embodiment to increase the stability of the safety pawls 4 before they are torn, to act as additional indicators of determining whether the safety pawls 4 have been torn, and to hide sharp protrusions by hiding the torn supporting pieces 32 at the inner side of the safety outer ring 3 as shown in FIGS. 8-9.

The first fixation wings 21 are multiple in terms of their quantity. The first fixation wings 21 are radially distributed between an inner wall of the grip ring 2 and the cap body 1 connecting the inner wall of the grip ring 2 and the cap body 1. The safety outer ring 3 is fixed by connecting the safety outer ring 3 with lower edges of the first fixation wings 21 as a one whole piece. The safety outer ring 3 is also fixed with lower edges of the second fixation wings 22 as a one whole piece.

The cap with a safety device according to the present embodiment has "double circles" against cheating behavior. As shown in FIG. 3, a first circle P is the safety outer ring 3 for the purpose of protection to protect and fix the safety pawls 4 not to be damaged intentionally or accidentally before they are torn. After the safety pawls 4 have been torn, the safety pawls 4 can be retained within the inner side of the safety outer ring 3 to prevent outward formation of sharp protrusions. Gaps 31 on the safety outer ring 3 are provided for sideward observation of whether the safety pawls 4 have ever been torn so as to determine whether the cap has ever been opened. Under antagonism with the ratchet teeth, the engagement ends of the safety pawls 4 perform irreversible rotation around their corresponding fixation ends and thus tear the safety pawls 4. The safety pawls 4 will not fall off after being torn, thereby being safer and more environmental-friendly.

Figure 4:
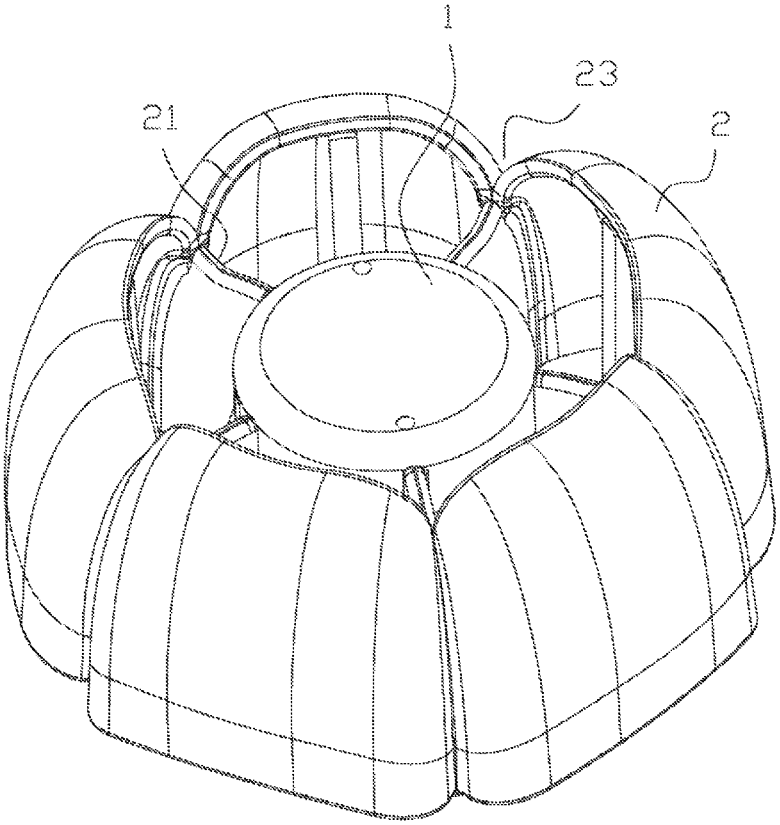
FIG. 4 is a perspective view of an embodiment of the cap of the present invention viewing from the top surface of the cap.
Figure 5:
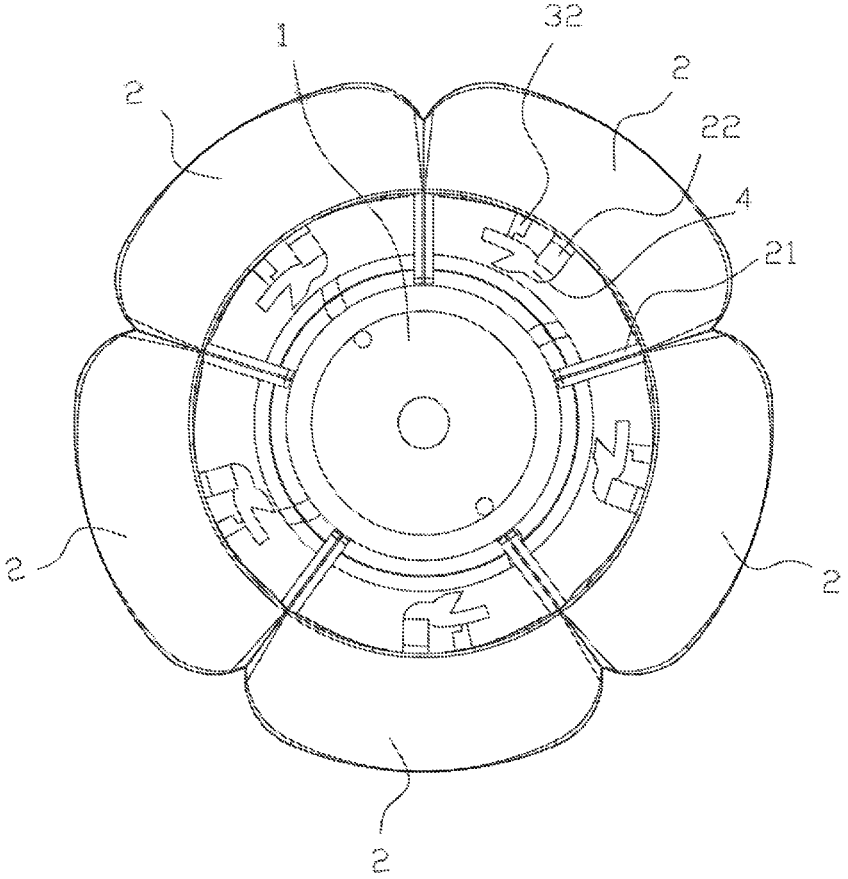
FIG. 5 is a top plan view of the cap according to an embodiment of the present invention.

The grip ring 2 is formed by five sections. The five sections continuously surround the outer periphery of the cap body 1. Troughs are provided between outer surfaces of two adjacent sections of the five sections. A top surface of the cap body 1 is lower than an edge of a top part of the grip ring 2. Recesses 23 are provided between top portions of two adjacent sections of the five sections, as shown in FIGS. 4, 6 and 7. These configurations have the following advantages: 1. Troughs provided on the outer surface of the grip ring 2 can achieve anti-slippery effect; 2. It is easier to position and grab the cap during production and processing; 3. Recesses 23 create sideward ventilation on the cap, so that air can enter into a space enclosed by the grip ring 2 through a recess between the top portions of any two adjacent sections, flow through the space between the top surface of the cap body 1 and the top portion of the grip ring 2, and then flow out from another recess, as such, the cap is enabled with both vertical and sideward ventilation to reduce the risk of suffocation in case the cap is accidentally swallowed by the kids.

Figure 10:
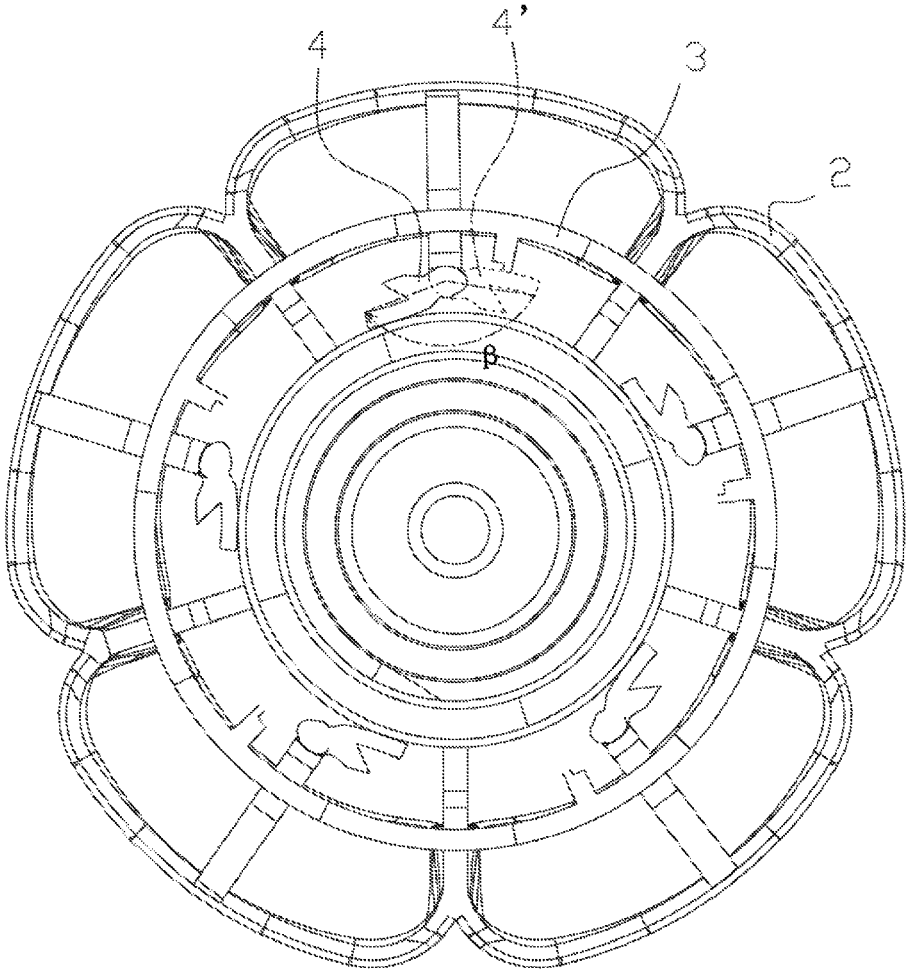
FIG. 10 is a schematic view showing a process of tearing the safety pawls of the cap according to an embodiment of the present invention.

FIG. 10 shows a modification of the present embodiment. In this modification, engagement ends of the safety pawls 4 rotate around their corresponding fixation ends within a circular plane on which the safety outer ring 3 is situated when the cap is rotated to open. In FIG. 10, a safety pawl indicated by broken lines 4' is within the circular plane on which the safety outer ring 3 is situated; when the cap is rotated to open, the safety pawl indicated by broken lines 4' antagonizes against a corresponding ratchet tooth and is then rotated by an angle β to reach a position indicated by solid lines in FIG. 10. This configuration has the advantage of further retaining any possible sharp protrusions within the enclosure of the safety outer ring 3 when the safety pawls 4 are torn.

Embodiment 2

The greatest difference between the cap of embodiment 1 and the cap of embodiment 2 is that, the cap of embodiment 2 does not have a grip ring.

Figure 11:
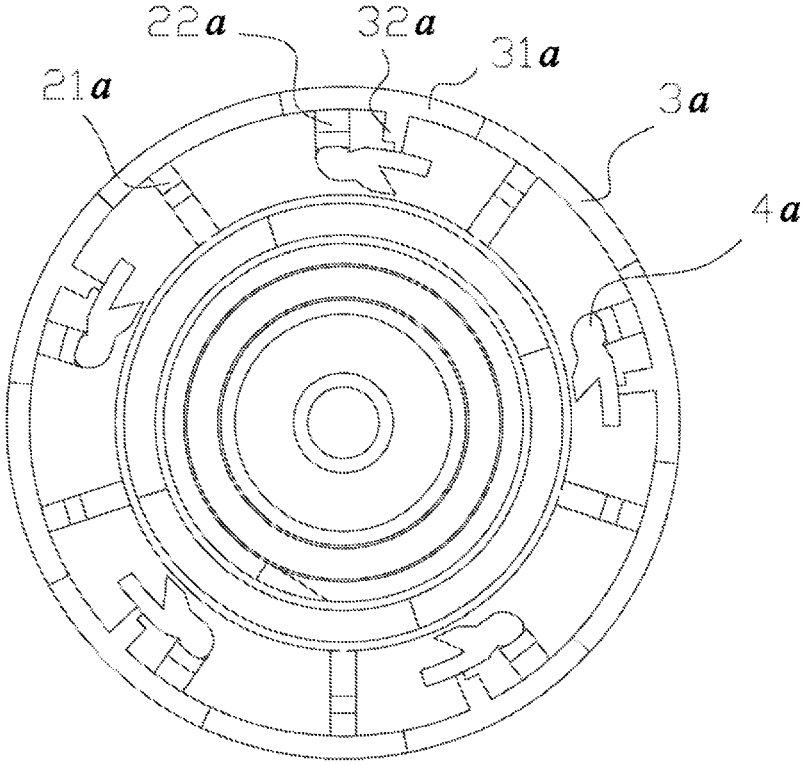
FIG. 11 is a bottom plan view of the cap according a second embodiment of the present invention.
Figure 12:
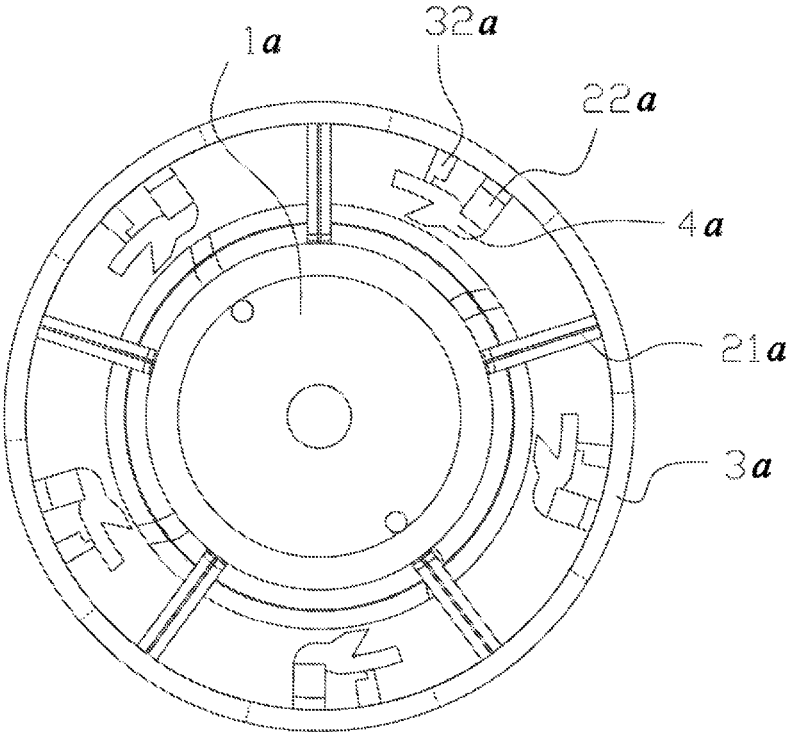
FIG. 12 is a top plan view of the cap according to a second embodiment of the present invention.

As shown in FIGS. 11-12, a cap with a safety device according to the present embodiment is rotatably mounted at a tubular opening of a packaging container. The tubular opening has ratchet teeth engaging with the cap around its outer periphery. The cap comprises a cap body 1*a*, a safety outer ring 3*a* and safety pawls 4*a*. The safety outer ring is fixed at outer side of a bottom end of the cap body. The safety pawls are multiple in terms of their quantity. The safety pawls are circularly distributed at inner side of the safety outer ring. Each of the safety pawls comprises a fixation end 22*a* and an engagement end. When the cap is rotated to open, each engagement end engages with a corresponding ratchet tooth and then rotates around a corresponding fixation end.

Gaps 31*a* corresponding to the safety pawls are provided on the safety outer ring so that the safety pawls can be observed through the gaps. Two sides of each gap on the safety outer ring are raised platforms. The safety outer ring also comprises supporting pieces 32*a* connecting engagement ends of the safety pawls with an inner surface of the safety outer ring. The supporting pieces will be torn when the engagement ends rotate around the fixation end. The safety outer ring and the safety pawls are radially exterior to the bottom end of the cap body.

The engagement end is a front end of its corresponding safety pawl along a direction of opening the cap by rotation; the fixation end is a rear end of its corresponding safety pawl along the direction of opening the cap by rotation. Each engagement end comprises an engagement slot; an opening of the engagement slot faces along the direction of opening the cap by rotation; the engagement slot fits and engages with a corresponding ratchet tooth; the engagement slot is formed as a notch created between two pawl legs extending away from each other according to a certain angle; the opening being formed as the engagement slot has a triangular shape.

Specifically, the safety outer ring can be fixed at an outer periphery of the bottom end of the cap body via fixation pieces 21*a* extending outwardly from an outer wall of the cap body. The safety pawls may either be fixed on an inner wall of the safety outer ring, or fixed at inner side of the safety outer ring via other fixation pieces extending outwardly from the bottom end of the cap body.

A person skilled in this field of art may change and modify the above embodiments in accordance with the teaching and disclosure of the present invention. Therefore, the present invention should not be limited to the embodiments disclosed and described above. Those changes and modification made in accordance with the teaching and disclosure of the present invention should fall within the scope of protection defined by the claims. Also, specific jargons used in the description are only intended to explain the invention conveniently but not intended to limit the present invention.

What is claimed is:

1. A cap with a safety device; the cap is rotatably mounted at tubular opening of a packaging container; outer periphery of the tubular opening is provided with ratchet teeth engaging with the cap; wherein the cap comprises a cap body, a safety outer ring and safety pawls; the safety outer ring is fixed at a bottom end of the cap body; the safety pawls are multiple in terms of quantity; the safety pawls are circularly distributed at an inner side of the safety outer ring; each of the safety pawls comprises a fixation end and an engagement end; when the cap is rotated to open, each engagement end engages with a corresponding ratchet tooth of the ratchet teeth and then perform irreversible rotation around its corresponding fixation end; gaps corresponding to the safety pawls are provided on the safety outer ring; the gaps are used for observing the safety awls two sides of each gap on the safety outer ring are raised platforms.

2. The cap as claimed in claim 1, wherein the cap also comprises supporting pieces connecting engagement ends of the safety pawls with an inner surface of the safety outer ring; the supporting pieces will be torn when the engagement ends rotate around their corresponding fixation ends.

3. The cap as claimed in claim 1, wherein the safety outer ring and the safety pawls are radially exterior to the bottom end of the cap body.

4. The cap as claimed in claim 1, wherein the engagement end is a front end of its corresponding safety pawl along a direction of opening the cap by rotation; the fixation end is a rear end of its corresponding safety pawl along the direction of opening the cap by rotation; each engagement end comprises an engagement slot; an opening of the engagement slot faces along the direction of opening the cap by rotation; the engagement slot fits and engages with a corresponding ratchet tooth of the ratchet teeth.

5. The cap as claimed in claim 4, wherein the engagement slot is formed as a notch created between two pawl legs extending away from each other according to a certain angle.

6. The cap as claimed in claim 1, wherein the cap also comprises a grip ring provided on an outer periphery of the cap body; the cap body and the grip ring are integrally connected with each other via first fixation wings; the first fixation wings are multiple in terms of quantity; the first fixation wings are radially distributed between an inner wall of the grip ring and the cap body connecting the inner wall of the grip ring and the cap body; the safety outer ring is fixed by connecting with lower edges of the first fixation wings as one whole piece.

7. The cap as claimed in claim 6, wherein the fixation end of each of the safety pawls is fixed at an end portion of a corresponding second fixation wing of multiple second fixation wings extending from an inner surface of the grip ring to the inner side of the safety outer ring.

8. The cap as claimed in claim 7, wherein the safety outer ring is also fixed with lower edges of the second fixation wings as one whole piece.

9. The cap as claimed in claim 6, wherein a vertical through passage is formed between the grip ring and the cap body.

10. The cap as claimed in claim 6 or 7, wherein the grip ring is a circular structure continuously surrounding the outer periphery of the cap body; or, the grip ring is formed by multiple sections continuously or discontinuously surrounding the outer periphery of the cap body.

11. The cap as claimed in claim 10, wherein recesses are provided between top portions of two adjacent sections; a top surface of the cap body is lower than an edge of a top part of the grip ring.

12. The cap as claimed in claim 10, wherein troughs are provided between outer surfaces of two adjacent sections.

13. The cap as claimed in claim 10, wherein there are four to six sections; the first fixation wings and the sections have the same quantity; the first fixation wings are positioned between connecting portions of adjacent sections and the cap body connecting the connecting portions of adjacent sections and the cap body; the second fixation wings and the sections also have the same quantity; the second fixation wings and the first fixation wings are arranged alternately; the safety pawls and the sections also have the same quantity.

* * * * *